US007438182B2

(12) United States Patent
Gamberi et al.

(10) Patent No.: US 7,438,182 B2
(45) Date of Patent: Oct. 21, 2008

(54) BLANK AND A RELATIVE PACKET OF CIGARETTES

(75) Inventors: Stefano Gamberi, Grizzana Morandi (IT); Fiorenzo Draghetti, Medicina (IT)

(73) Assignee: G.D S.p.A., Bologna (IT)

( * ) Notice: Subject to any disclaimer, the term of this patent is extended or adjusted under 35 U.S.C. 154(b) by 147 days.

(21) Appl. No.: 10/450,952

(22) PCT Filed: Dec. 17, 2001

(86) PCT No.: PCT/IB01/02568

§ 371 (c)(1),
(2), (4) Date: Jun. 18, 2003

(87) PCT Pub. No.: WO02/49940

PCT Pub. Date: Jun. 27, 2002

(65) Prior Publication Data

US 2004/0055909 A1 Mar. 25, 2004

(30) Foreign Application Priority Data

Dec. 18, 2000 (IT) ..... BO2000A0729

(51) Int. Cl.
*B65D 85/10* (2006.01)

(52) U.S. Cl. ..... 206/259; 206/268

(58) Field of Classification Search ..... 206/259, 206/265, 268, 271, 273
See application file for complete search history.

(56) References Cited

U.S. PATENT DOCUMENTS 4,923,059 A * 5/1990 Evers et al. ..... 206/265
5,044,550 A * 9/1991 Lamm ..... 229/160.1
D322,687 S * 12/1991 Tschudin ..... D27/189
5,143,282 A * 9/1992 Pham ..... 229/160.1
5,392,905 A 2/1995 Focke et al.
5,823,331 A * 10/1998 Manservigi et al. ..... 206/268
5,896,984 A 4/1999 Focke et al.
5,904,244 A * 5/1999 Focke et al. ..... 206/268
6,276,600 B1 * 8/2001 Rigby ..... 229/128
6,343,691 B1 * 2/2002 Focke et al. ..... 206/268
6,457,580 B1 10/2002 Focke et al.
6,484,930 B1 * 11/2002 Draghetti ..... 229/146

(Continued)

FOREIGN PATENT DOCUMENTS

CA 1173412 8/1984

(Continued)

*Primary Examiner*—Shian T. Luong
(74) *Attorney, Agent, or Firm*—Timothy J. Klima

(57) ABSTRACT

A cigarette packet (4) with a cross section of flattened oval profile is fashioned from a diecut blank (1) of essentially elongated rectangular outline referable to a longitudinal axis (16) and comprising, aligned along the axis (16), a central panel (17), two intermediate panels (18, 19) and two end panels (20, 21), each intermediate panel (18, 19) displaying a flattened oval outline and joined to the two contiguous panels (17, 20; 17, 21) along respective rectilinear borders (22) extending transversely to the longitudinal axis (16) and interconnected in pairs by way of respective arcuate borders (23) with no break in linear continuity. The central panel (17) and end panels (20, 21) each present a flat central longitudinal area (24) and two lateral longitudinal bands (25) rendered pliable and thus adaptable to the curvature described by the arcuate borders (23), which they are designed to meet when the packet (4) is erected.

11 Claims, 5 Drawing Sheets

U.S. PATENT DOCUMENTS

| | | | | |
|---|---|---|---|---|
| 6,592,023 | B2 * | 7/2003 | Li Vigni et al. | 229/146 |
| 6,755,300 | B2 * | 6/2004 | Brizzi | 206/273 |

FOREIGN PATENT DOCUMENTS

| | | |
|---|---|---|
| DE | 3037109 | 4/1981 |
| DE | 3116924 | 2/1983 |
| DE | 19644759 | 4/1998 |
| DE | 19858781 | 12/1999 |
| WO | 0043289 | 7/2000 |

* cited by examiner

BLANK AND A RELATIVE PACKET OF CIGARETTES

This application is the National Phase of International Application PCT/IB01/02568 filed Dec. 17, 2001 which designated the U.S. and that International Application was published under PCT Article 21(2) in English.

TECHNICAL FIELD

The present invention relates to a diecut blank for use in manufacturing of a packet of cigarettes.

BACKGROUND ART

The prior art embraces a packet of rigid type as disclosed in European patent EP 0 545 723, to which reference may be made for a full description, intended to hold a group of cigarettes enveloped previously in a respective inner wrapper of metal foil paper. The packet comprises a container with an internal stiffening frame, also a lid hinged to the container and rotatable about the respective hinge line between an open position affording access to the container, and a closed position in which the lid fits snugly over the frame and is held thus stably in place. The packet in question presents a cross section of substantially flattened oval profile and is fashioned from a flat precreased diecut blank referable to a predominating axis disposed transversely to the axis of the finished packet and presenting a plurality of panels, aligned along the selfsame axis, destined to provide both the sides of the container and of the lid, and the internal frame.

Also forming part of the blank are two pairs of end folds, each presenting an outline of substantially flattened oval profile, aligned in two sets of two along the aforementioned transverse axis and providing the elements by which the top end and bottom end faces of the packet are fashioned.

Besides being unsuitable for use on today's high speed packer machines, which will only handle blanks exhibiting a transverse dimension decidedly less than the longitudinal dimension, the type of blank described above can also be affected by the problem of incorrect mutual positioning between the outer wrapper and the inner wrapper. In effect, given the particular geometry of the blank, the packet is fashioned by bending the blank about an axis perpendicular to the transverse axis and rolling it gradually into a tube around the inner wrapper, interacting in the process with the selfsame inner wrapper, to the point of assuming the aforementioned substantially flattened oval profile. Thus, the inner wrapper functions to all intents and purposes as a mandrel around which the blank is formed by degrees.

It has been found by experiment that this type of wrapping operation can occasion relative movement between the inner wrapper and the outer wrapper, resulting in the drawback mentioned above and consequently in a loss of the correct mutual positioning between the two wrappers.

The object of the present invention is to overcome the above noted drawbacks.

It is also known, from document U.S. Pat. No. 5,392,905, a hinged lid packet for cigarettes which comprises a pack part and a lid pivotally attached to the pack part. The pack part presents a front panel, a rear panel, two lateral panels and a bottom; the lid comprises a lid front panel, a lid rear panel, two side panels and an end panel. The four longitudinal edges of the packet are rounded and are defined by a plurality of parallel grooves. The packet is formed from a first blank presenting a central panel, two intermediate panels and two end panels. The intermediate panels, which form the bottom and the end panel of the packet, present a substantially rectangular shape with rounded edges. The packet further comprises a collar formed from a separate blank.

DISCLOSURE OF THE INVENTION

The stated object is realized according to the present invention in a blank for manufacturing a packet of cigarettes exhibiting a cross section of substantially flattened oval profile, characterized in that it presents a substantially elongated rectangular outline referable to a longitudinal axis parallel with the longitudinal axis of the relative packet and comprises, aligned along the selfsame axis, a central panel, two intermediate panels and two end panels, of which the intermediate panels each present a substantially flattened oval outline and are joined respectively to the two contiguous panels along rectilinear borders extending transversely to the longitudinal axis and interconnected in pairs by way of respective arcuate borders with no break in linear continuity, whilst the central panel and end panels present respective flat central longitudinal areas, terminating longitudinally in extremities that coincide with the rectilinear borders, and two respective lateral longitudinal bands designed to meet the intermediate panels along the arcuate borders.

The invention will now be described in detail, by way of example, with the aid of the accompanying drawings, in which.

Figure 1:
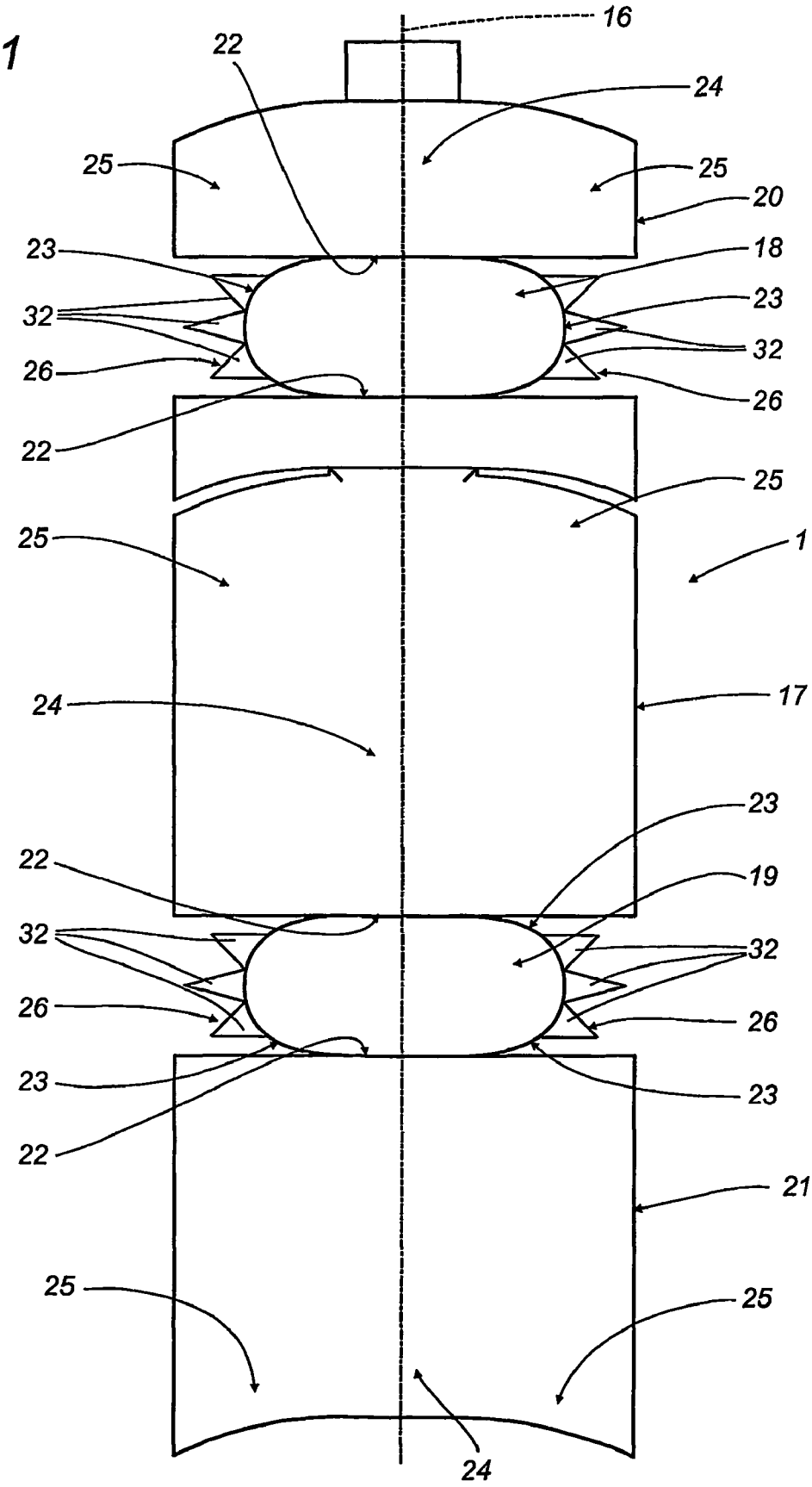
FIGS. 1 to 3 illustrate three different types of blanks for the manufacture of respective packets of cigarettes according to the present invention, viewed in plan.
Figure 2:
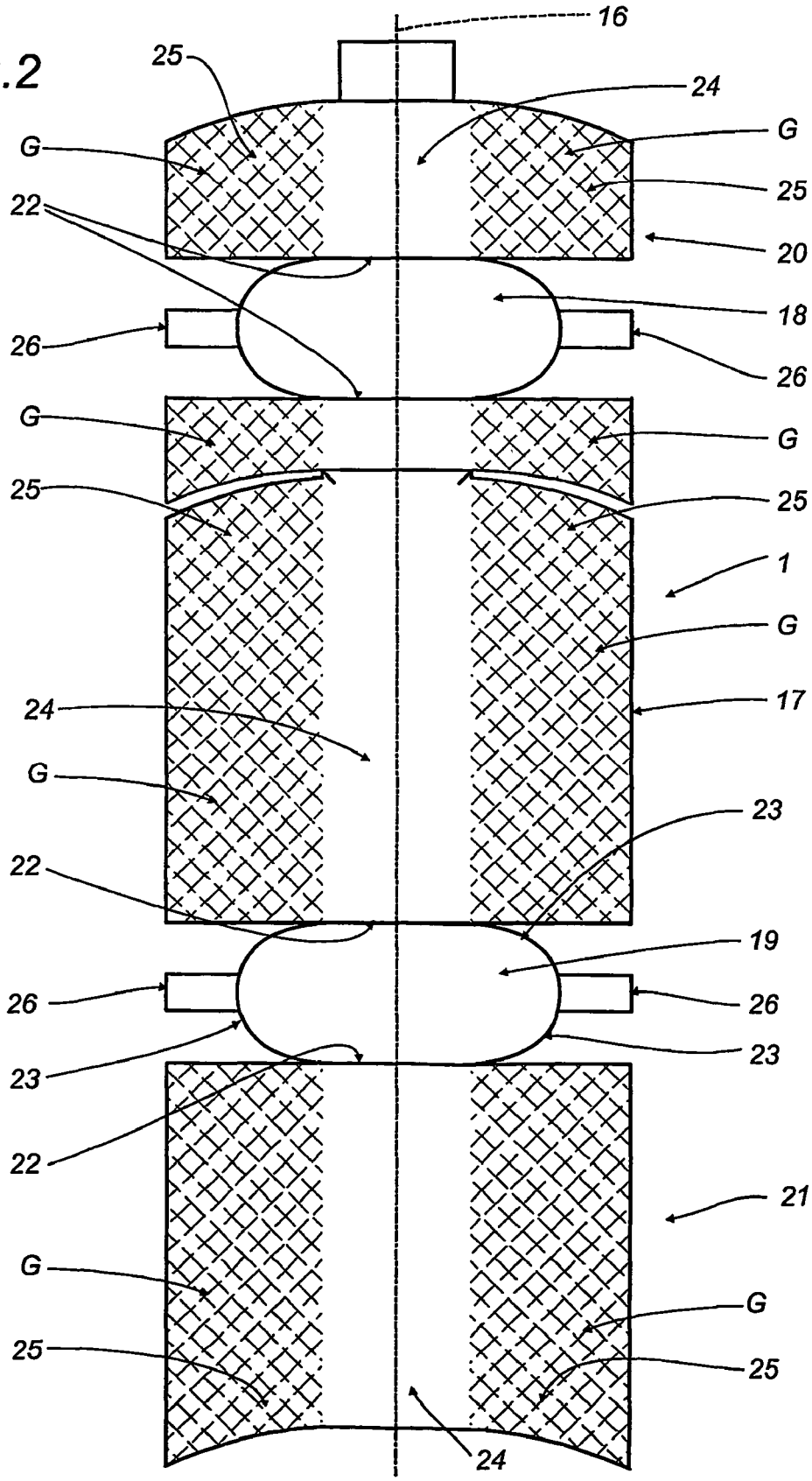
Figure 3:
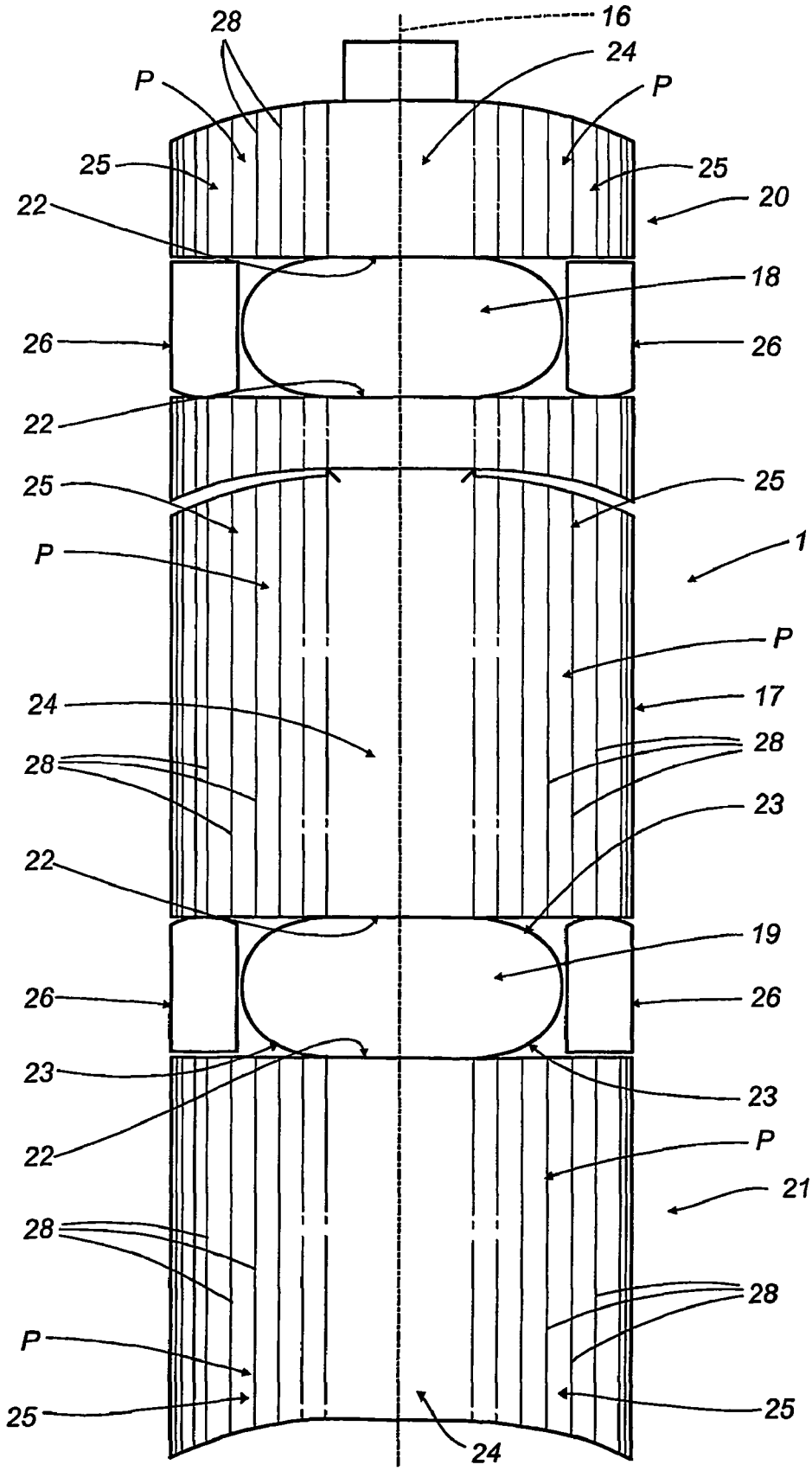

With reference to FIGS. 1, 2 and 3, of the drawings, 1 denotes a flat diecut blank, in its entirety, made of a wrapping material such as cardboard or the like, from which to fashion a packet; in particular, the blank 1 is associated with a respective stiffening frame 2 fashioned in its turn from a flat diecut blank 3, and formed into a relative cigarette packet 4 (see FIG. 7) referable to a predominating longitudinal axis 5, presenting a substantially flattened oval profile when seen in cross section and accommodating a group of cigarettes (not illustrated).

Figure 7:
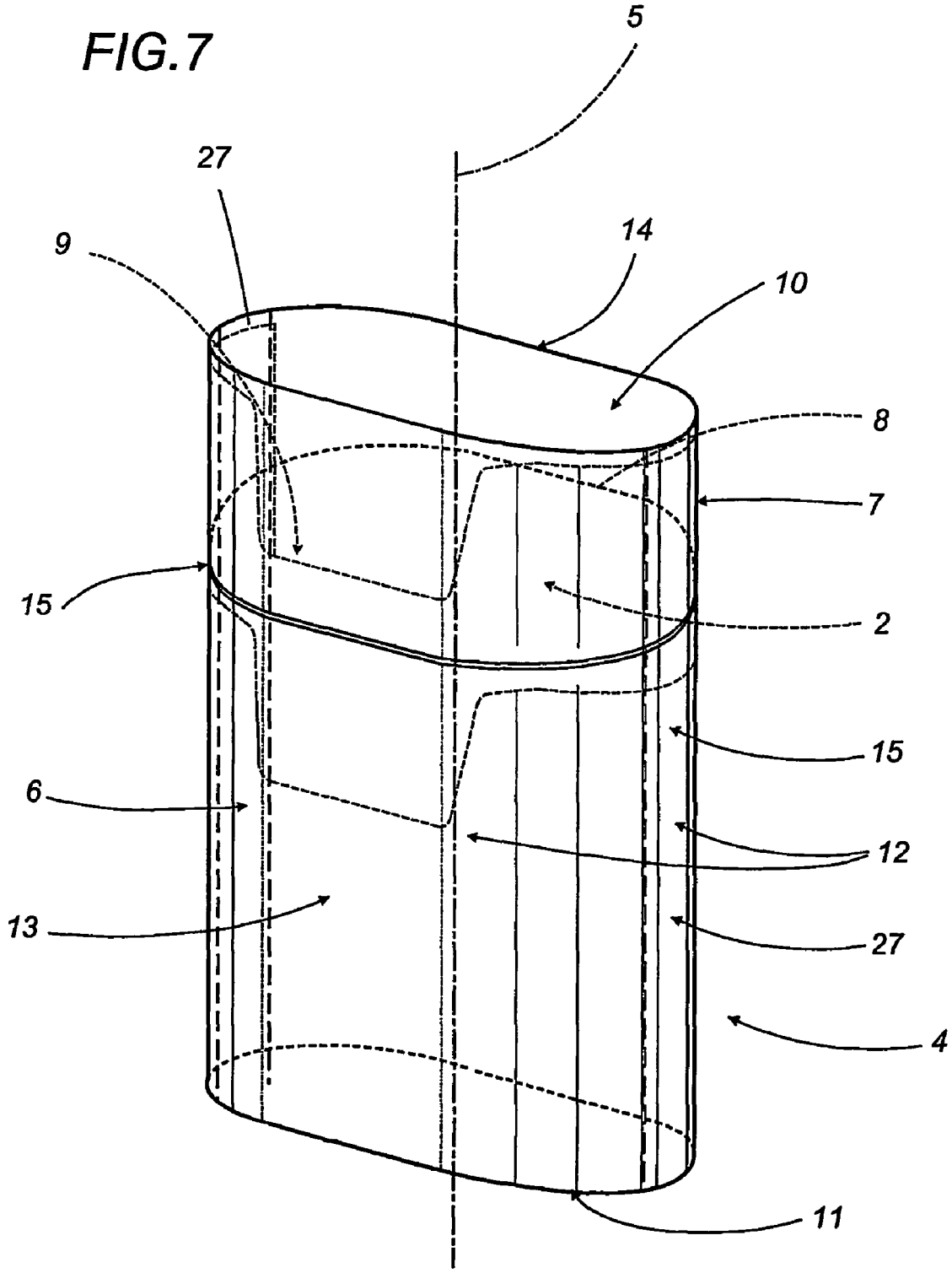
FIG. 7 illustrates a packet of cigarettes fashioned, purely by way of example, from the blank of FIG. 3.

Referring to FIG. 7, the packet 4 is of rigid embodiment and comprises a container 6, surmounted by a lid 7 hinged to the selfsame container 6 along a crease line 8 and rotatable thus between an open position (not illustrated), and a closed position in which the lid covers an open top end 9 of the container 6 and is retained in this same position by the frame 2.

The packet 4 presents a top end face 10 and a bottom end face 11 of substantially flattened oval outline, and a lateral surface 12 including two mutually parallel flat portions denoted 13 and 14, front and rear respectively. The two flat portions 13 and 14 are interconnected by two arcuate portions 15.

As illustrated in FIGS. 1, 2 and 3, the blank 1 presents a substantially elongated rectangular outline referable to a longitudinal axis 16 and comprises, aligned along this same axis 16, a central panel 17, two intermediate panels 18 and 19 and two end panels of which one, denoted 20, is joined to the central panel 17 by way of one intermediate panel 18, and the other, denoted 21, joined to the central panel 17 by way of the other intermediate panel 19.

The two intermediate panels 18 and 19 present a substantially flattened oval outline and are joined to the respective contiguous panels 20-17 and 21-17 along rectilinear borders 22 that extend transversely to the longitudinal axis 16 and are interconnected in corresponding pairs by respective arcuate borders 23 with no break in linear continuity.

The central panel 17 and the end panels 20 and 21 each exhibit a central longitudinal area 24 of width equal to the length of the aforementioned rectilinear borders 22, so that the extremities of these same areas 24 coincide with the borders 22 along which the intermediate panels 18 and 19 are joined, also two lateral longitudinal bands 25 extending parallel to the central area 24 and designed, when the packet 4 is erected, to meet the intermediate panels 18 and 19 along the aforementioned arcuate borders 23 whereupon they are anchored to the selfsame panels 18 and 19 by means of flaps 26. In the example of FIG. 1 the flaps 26 are integral with the arcuate borders 23 of the intermediate panels 18 and 19 and embodied as a plurality of tongues 32 each presenting a substantially triangular outline and projecting radially from the selfsame arcuate border 23.

In particular, the central longitudinal portion 24 of the central panel 17 coincides with the rear flat portion 14 of the packet 4, the central portions 24 of the end panels 20 and 21 coincide with the front flat portion 13 of the packet 4, and the intermediate panels 18 and 19 coincide respectively with the top end face 10 and with the bottom end face 11 of the packet 4. Finally, the lateral longitudinal bands 25 coincide with the arcuate portions 15 of the packet 4 and are secured one to another along a narrow overlap denoted 27.

In contrast to the example of FIG. 1, the lateral longitudinal bands 25 in the examples of FIGS. 2 and 3 are rendered pliable and thus made readily adaptable, when the packet 4 is erected, to the curvature of the arcuate borders 23 presented by the intermediate panels 18 and 19.

In the example of FIG. 2 the lateral longitudinal bands 25 are rendered pliable and adaptable to the required curvature by means of an embossing operation denoted G. In this instance the flaps 26 present a rectangular outline and project from the arcuate borders 23 of the intermediate panels 18 and 19.

In the example of FIG. 3 the lateral longitudinal bands 25 are rendered pliable and adaptable to the required curvature by means of an operation denoted P that consists in generating a plurality of crease lines 28. In this instance the flaps 26 are integral with the lateral bands 25 of the central panel 17 and extend parallel to the longitudinal axis 16.

Importantly, the separation between the lateral longitudinal bands 25 and the central area 24 is not evidenced by a clear line of demarcation; rather, the bands 25 and the central area 24 merge with no break in continuity, so that the packet 4 can be fashioned without any ridges generated between the flat portions 13 and 14 and the arcuate portions 15.

Figure 4:
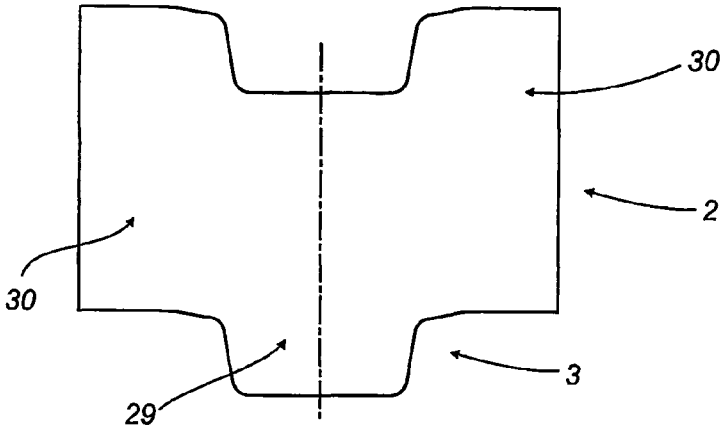
FIGS. 4 to 6 illustrate three different types of blanks for the manufacture of respective frames to be associated with the respective types of blanks shown in FIGS. 1 to 3.
Figure 5:
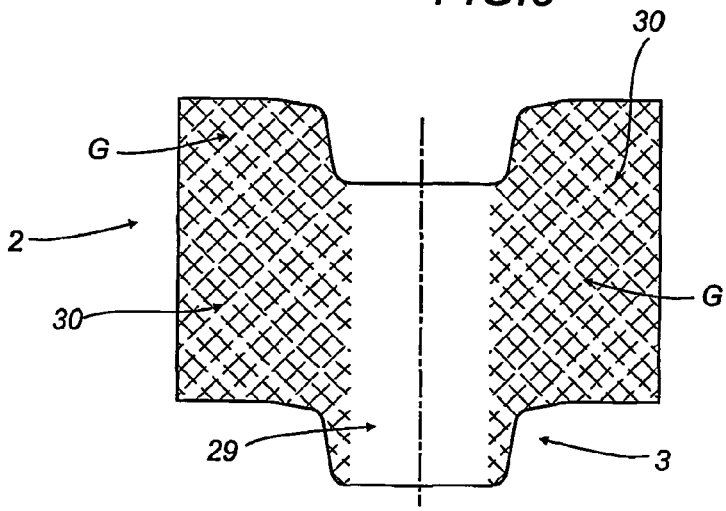
Figure 6:
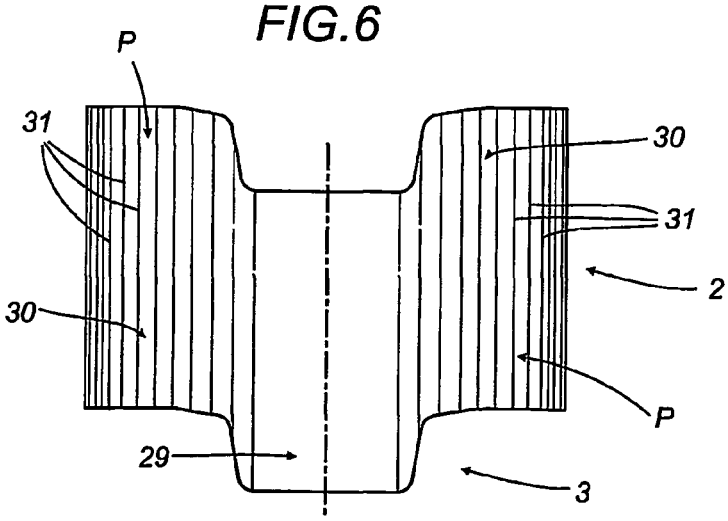

In the same manner as described for the packet blanks 1, the blanks 3 utilized for the frames 2 illustrated in FIGS. 4, 5 and 6 present a central longitudinal area 29 that will be breasted with the central area 24 of the end panel 21, and two lateral longitudinal bands 30 that will be breasted in part with the lateral longitudinal bands 25 of the selfsame panel 21. More exactly, the lateral longitudinal bands 30 in the example of FIG. 5 are rendered pliable and adaptable to the required curvature by means of an embossing operation similar to that effected on the lateral bands 25 of the packet blank 1 and denoted G likewise on the frame blank 3, whereas the lateral longitudinal bands 30 in the example of FIG. 6 are rendered pliable and adaptable to the required curvature by means of an operation P that consists in generating a plurality of crease lines 31, the same as on the corresponding bands 25 of the blank illustrated in FIG. 3.

Likewise in the case of the blanks 3 from which the frames 2 are fashioned, the separation between the lateral bands 30 and the central area 29 is not evidenced by a clear line of demarcation; rather, the bands 30 and the central area 29 merge with no break in continuity and are thus able to bond completely with the internal surface of the packet 4.

The invention claimed is:

1. A diecut blank for manufacturing a packet of cigarettes having a longitudinal axis parallel with a longitudinal axis of the respective packet and comprising, aligned along the longitudinal axis, a central panel, two intermediate panels and two end panels, the intermediate panels being joined to respective two contiguous panels along rectilinear borders extending transversely to the longitudinal axis and interconnected in pairs by respective arcuate borders without any discontinuity, the central panel and end panels including respective flat central longitudinal areas terminating longitudinally in extremities that coincide at least in part with the rectilinear borders and two respective lateral longitudinal bands constructed and arranged to meet the intermediate panels along the arcuate borders; the intermediate panels each including a flattened oval outline to define a packet having a cross section of flattened oval profile; and further comprising flaps by which the intermediate panels are connected to the respective central and end panels, the flaps being integral with the arcuate borders and embodied as a plurality of tongues on each arcuate border, each tongue having a substantially triangular outline and projecting radially from the arcuate border.

2. A blank as in claim 1, wherein the lateral bands are rendered pliable and adaptable to the curvature of the arcuate borders.

3. A blank as in claim 2, wherein the lateral bands are embossed for rendering pliable and adaptable to the curvature.

4. A packet of cigarettes of rigid type manufactured from a blank as claimed in claim 3 comprising a container, a lid and a frame, wherein the frame is fashioned from a respective flat diecut blank having a central area and two respective lateral longitudinal bands.

5. A blank as in claim 2, wherein the lateral bands comprise a plurality of longitudinal crease lines such that they are pliable and adaptable to the curvature.

6. A packet of cigarettes of rigid type manufactured from a blank as claimed in claim 2 comprising a container, a lid and a frame, wherein the frame is fashioned from a respective flat diecut blank having a central area and two respective lateral longitudinal bands.

7. A packet of cigarettes of rigid type manufactured from a blank as claimed in claim 2 comprising a container, a lid and a frame, wherein the frame is fashioned from a respective flat diecut blank having a central area and two respective lateral longitudinal bands.

8. A packet of cigarettes of rigid type manufactured from a blank as claimed in claim 1, comprising a container, a lid and a frame, wherein the frame is fashioned from a respective flat diecut blank having a central area and two respective lateral longitudinal bands.

9. A packet as in claim 8, wherein the lateral bands of the blank used for the frame are rendered pliable so as to make them adaptable to the curvature of the arcuate borders presented by the intermediate panels of the packet blank.

10. A packet as in claim 8, wherein the lateral bands are embossed to be pliable and adaptable to the curvature.

11. A packet as in claim 8, wherein the lateral bands comprises a plurality of longitudinal crease lines to be pliable and adaptable to the curvature.

* * * * *